United States Patent [19]

Marforio

[11] 4,067,273

[45] Jan. 10, 1978

[54] DEVICE FOR CUTTING AND INSERTING A STRIP BENEATH THE PRESSER FOOT OF A SEWING MACHINE

[75] Inventor: Nerino Marforio, Milan, Italy

[73] Assignee: Rockwell-Rimoldi S.p.A., Milan, Italy

[21] Appl. No.: 727,875

[22] Filed: Sept. 29, 1976

[30] Foreign Application Priority Data

Oct. 3, 1975 Italy ..... 27914/75

[51] Int. Cl.[2] ..... D05B 37/04; D05B 35/06

[52] U.S. Cl. ..... 112/130; 112/121.26; 112/121.27; 112/152

[58] Field of Search ..... 112/130, 129, 122, 152, 112/136, 153, 121.27, 121.26

[56] References Cited

U.S. PATENT DOCUMENTS

| | | | |
|---|---|---|---|
| 1,195,767 | 8/1916 | Berger, Jr. | 112/152 X |
| 2,862,467 | 12/1958 | Passaro et al. | 112/121.27 X |
| 3,011,460 | 12/1961 | Haff, Jr. | 112/130 |
| 3,515,081 | 6/1970 | Miller | 112/130 |
| 4,024,824 | 5/1977 | Haff, Jr. | 112/121.26 |

*Primary Examiner*—H. Hampton Hunter

[57] ABSTRACT

An improved mechanism for cutting and inserting a strip of elastic material or the like beneath the presser foot of a sewing machine in which guide means is provided which automatically adjusts its position relative to the presser foot regardless of the height of the presser foot and which feeds the elastic material into position for stitching beneath the presser foot.

5 Claims, 5 Drawing Figures

DEVICE FOR CUTTING AND INSERTING A STRIP BENEATH THE PRESSER FOOT OF A SEWING MACHINE

BACKGROUND OF THE INVENTION

The present invention relates to a device for feeding and cutting a strip of any type of material on a sewing machine.

Devices are already known which are designed to feed a strip of flexible material such as elastic material unwound from a continuous roll for the purpose of inserting it beneath the presser foot of a conventional sewing machine in order to sew the strip to a layer of fabric. These devices are also equipped with a device for cutting the strip so as to enable a piece of the same to be sewn to the layer of fabric.

According to the prior art, a guide is used for reinserting the strip piece, which has been precut from the roll, beneath the presser foot; the strip being made to slide along the guide by pushing means acting on the strip along the guide. As soon as the strip is inserted beneath the presser foot, it is removed from the roll by the feed mechanisms of the sewing machine.

The guide extends into the vicinity of the presser foot and the stitch forming mechanisms but it is spaced apart from the same to enable the cutting means to cut the strip at the end of the stitching operations. In the conventional devices, the distance between the lower end of the guide and the presser foot renders insertion of the strip beneath the presser foot extremely difficult in that the strip rolls up very easily owing to the inevitable folds or snags already present in the strip or produced by cutting the same. In any case, the strip, per se, will tend to roll up in front of the presser foot, particularly when the strip consists of extremely flexible material.

Furthermore, certain conventional devices are equipped with a delivery mechanism designed to facilitate insertion of the strip beneath the presser foot; this delivery mechanism being rigidly connected to the presser foot and its height being such that when the presser foot is raised it is moved against the end part of the guide so as to produce a continuous guide channel for the strip.

The disadvantage of this solution is that, as the presser foot is raised to different levels in different types of sewing machines, it will be necessary to provide delivery means of different height for each type of machine, thus reducing the space needed by the cutting devices which operate between the guide and the deliver means.

The object of the present invention is to render the device universally applicable and thus enable it to be used on any type of sewing machine regardless of the distance by which the presser foot is raised.

Another object of the present invention is that of also enabling the strip to be inserted beneath the presser foot when the sewing machine is in operation. The technical problem to be solved is that of producing a device in which the continuity of the guide channel is independent of the raising path of the presser foot without having to resort to position adjustment of the guide and the cutting device.

SUMMARY OF THE INVENTION

The above-defined technical problem is optimally solved by means of the device according to the present invention for cutting and inserting a strip beneath the presser foot of a sewing machine comprising a guide along which the strip is made to slide by pushing means during the stage of inserting the same beneath the presser foot; means for cutting the strip being disposed between the presser foot and the lower end part of the guide; characterized in that the device comprises means for moving the guide from a rest position remote from the stitching zone to a position for insertion of the strip beneath the presser foot and for returning this guide into the rest position after the strip has been inserted beneath the presser foot by the pushing means.

These and other features will be made apparent in the course of the following description of a preferred but not exclusive embodiment of the invention which is provided by way of a non-limitative example only with reference to the accompanying drawings, in which:

DESCRIPTION OF THE PREFERRED EMBODIMENT

Figure 1:
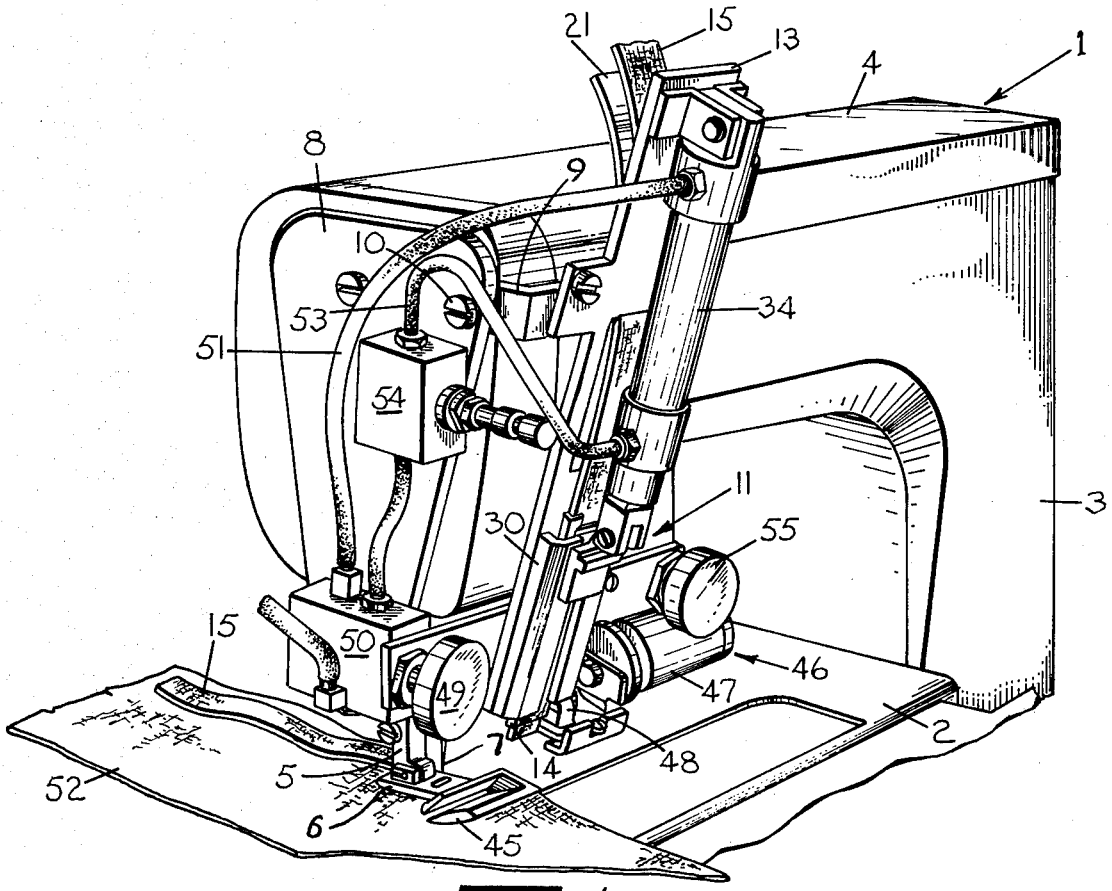
FIG. 1 is a perspective view of a sewing machine equipped with the strip cutting and insertion device according to the present invention.

Referring now to FIG. 1 the device according to the present invention is mounted on a conventional sewing machine 1 comprising a conventional base 2, to which the hollow part 3 is rigidly attached. The hollow part 3 supports the arm 4 whose free end houses, inter alia, the presser bar 5 bearing a presser foot 6 and the needle 7 carried by a conventional needle bar (not shown in the drawings).

Figure 2:
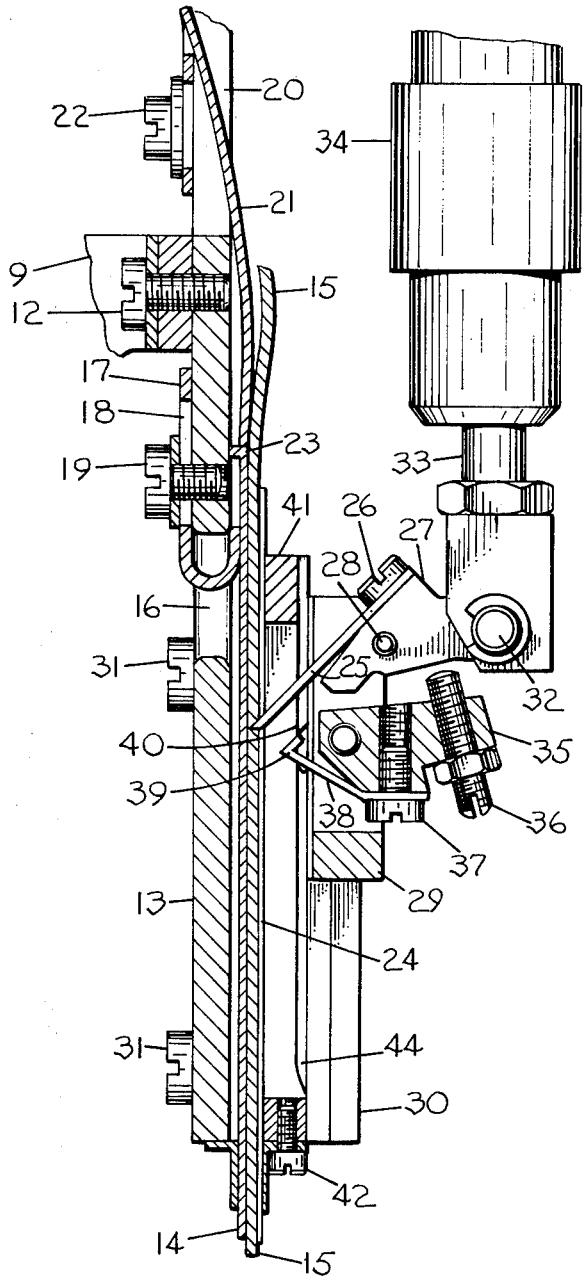
FIG. 2 is a lateral, partial sectional view of the strip insertion device.

The system for raising the presser foot 6 is pneumatic and will be described hereinafter. A plate 8 is attached to the end of the arm 4 of the sewing machine. An angular bracket 9 adapted to rotate about a hinge screw 10 is hinged to the plate 8. The rotation of the bracket 9 about the hinge screw 10 makes it possible to adjust the inclination of the entire device with respect to a vertical axis and to pivot the device until it is above the arm 4 of the sewing machine, thus facilitating any maintenance work on the stitching mechanisms. The bracket 9 supports a strip insertion device designated in total by the reference number 11. Referring now to FIG. 2, a slide plate 13 of a guide 14, in which a strip 15 is inserted, is attached by means of a screw 12 to the bracket 9. The plate 13 bears a slot 16 in which a stroke limiting member 17 is inserted. The member 17 also comprises a slot 18 enabling it to be positioned on the plate 13 by the locking action of a screw 19.

The plate 13 also comprises an orifice 20 through which a leadin plate 21 is passed. The plate 21 is attached by means of a screw 22 to the plate 13 and strip 15 slides along the same.

The guide 14 consists of a tubular element having a substantially rectangular section. At the upper part of one side it comprises a tooth 23 designed to cooperate with the stroke limiting member 17 and on its other side it comprises an aperture 24 running along its entire length. A plate 25 is adapted to be inserted in and to slide in the aperture 24. The plate 25 is attached by means of a screw 26 to a support 27 oscillating about a pin 28 supported by a first carriage 29 slidable along two rails 30 rigidly connected to the plate 13 by means of screws 31.

The rod 33 of a two-way pneumatic cylinder 34 is hinged at 32 to the support 27.

A small block 35 is attached to the first carriage 29. The block 35 is equipped with an adjustment screw 36 designed to strike against the support 27 and intended to limit the rotation of the support 27 about the pin 28.

Figure 3:
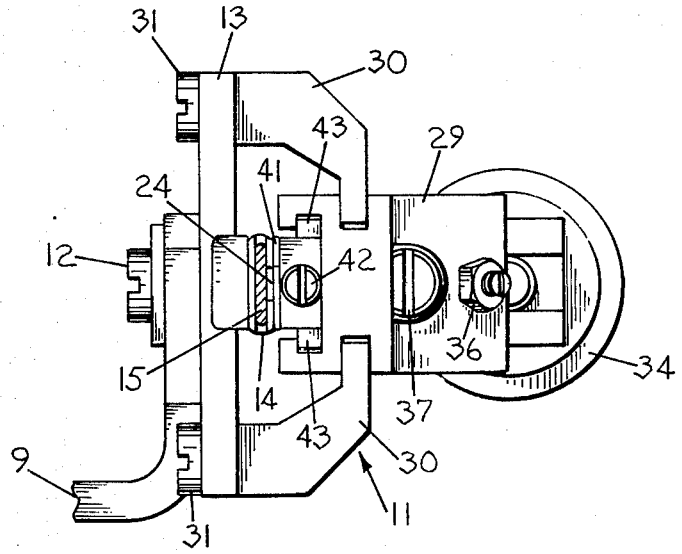
FIG. 3 is a view from below the device shown in FIG. 2.

A spring 38 is also attached to the block 35 by means of a screw 37. The spring 38 comprises a tooth 39 designed to be inserted in a seat 40 of a second carriage 41. The guide 14 is attached to the carriage 41 by means of a screw 42. The second carriage 41 is supported by two guide extensions 43 (FIG. 3) slidable along corresponding seats provided in the first carriage 29.

The second carriage 41 also comprises a groove 44 in which the tooth 39 of the spring 38 is adapted to slide.

A funnel delivery element 45 is rigidly connected to the presser foot 6. The element 45 has a rectangular section and is open at its lower part and laterally. The lower opening in the delivery element is disposed in the same plane as the base of the presser foot. Conventional scissor-type cutting means 46, controlled by a pneumatic cylinder 47, are disposed in the free zone between the opening of the delivery element and the lower end of the guide to the righthand side of the guide per se. The cutting means 46 used to cut the strip 15 is such that the pneumatic cylinder 47 not only produces the simultaneous closing or opening of cutting blades 48 but also the translational movement of the plates per se in the operating direction of the cylinder so as to move the cutting means towards or away from the zone between the delivery means and the guide; the strip 15 passing through this zone.

The mode of operation of the device will now be described in reference to FIGS. 1 and 2.

The preliminary operations consist in manually inserting the strip 15 into the guide 14 and beneath the plate 25 which, together with the cylinder 34, constitute the means for pushing the strip.

By depressing a push button 49 of a valve 50 inserted in a compressed air line, compressed air is introduced into the branch 51 which is used to raise the presser foot before the movement of the rod of the cylinder 34 is begun. The supplying of compressed air into the cylinder 34 in its upper part causes the plate 25 to be lowered. The plate 25 acts on the strip 15 and pushes it downwards. The supplying of air to the cylinder 34 simultaneously causes the guide 14 to be lowered owing to the fact that the tooth 39 supported by the first carriage displaced by the cylinder 34 pushes the second carriage 41 downwards. The spring 38 equipped with a tooth 39 and the second carriage 41 constitute the means for displacing the guide 14.

The downward movement of the second carriage 41 and of the guide 14 continues until the tooth 23 of the guide strikes against the stroke limiting member 17. At this point the guide is arrested and is now located in a position in which its lower end is in contact with the delivery means 45.

The path of the first carriage 29 and thus the downward movement of the strip 15, can continue owing to the fact that the tooth 39 is removed from its seat 40 and it slides in the guide groove 44.

The end of the strip 15 is carried beneath the presser foot in correspondence with the stitching mechanisms in that the stroke of the cylinder 34 is substantially equal to the distance between the lower end of the guide 14 and the stitching mechanisms.

A layer of fabric 52 can now be placed manually beneath the presser foot.

When the push button 49 is now released, the branch 51 ceases to be supplied and the air is switched to the branch 53. As a result, the cylinder 34 is supplied with air at its lower part and thus the first carriage 29 bearing the plate 25 is raised. As the latter is tilted, it does not drag behind it the strip 15.

When the first carriage reaches the seat 40, the tooth 39 is inserted therein. The tooth 39 pulls upwards the second carriage 41 and thus the guide 14. When the push button 49 is released, the presser foot is thus first lowered onto the strip 15, thus pinning down the same, and the carriage 29 is raised in the above-described manner. The rate at which the plate 25, and thus the piston of the cylinder 34 is lowered can be regulated by adjusting the stroke regulator 54. The sewing machine can now be started owing to the fact that the workpiece and the strip are already disposed beneath the presser foot. During the stitching operation the strip 15 is removed from the roller by the conventional feed mechanisms of the sewing machine and the plate 25 does not obstruct this removal operation owing to the fact that its pressure on the strip is so adjusted that it does not hamper the pulling action exerted on the strip by the feed mechanisms. When a specific length of strip has been attached to the layer of fabric 52, the sewing machine is stopped and a push button 55 is depressed. This causes the cylinder 47 operating the strip cutting means to be supplied. When the strip has been cut and the push button 55 released, the sewing machine can be restarted in order to sew the piece of the strip remaining in the deliver means, or alternatively the push button 49 can be depressed so as to raise the presser foot in order to remove the workpiece and reinsert the strip beneath the presser foot.

Although the present invention has been described in connection with a preferred embodiment, it is to be understood that modifications and variations may be resorted to without departing from the spirit and scope of the invention and the appended claims.

What is claimed is:

1. A device for cutting and inserting a strip beneath the presser foot of a sewing machine for attachment during the stitching operation to a workpiece, said device comprising:

a. a guide bar (14) slidably mounted on the sewing machine for guiding strip material from its source to the presser foot;

b. means operatively connected to said guide bar for moving it between an operating position in close proximity to the presser foot and an inactive position spaced therefrom;

c. means carried and actuated by said moving means for engaging and advancing the strip material while said guide bar is in its operating position to effect movement thereof to a position beneath the presser foot; and d. cutting means attached to the sewing machine and movable to a position in operative association with the presser foot and guide bar for selectively cutting the strip material extending therebetween when said guide bar (14) is in its inactive position.

2. The device according to claim 1 wherein said moving means includes a pneumatic cylinder (34) with a stroke limiting member (17) operatively associated therewith for controlling the movement of said guide bar (14) to its operating position.

3. The device according to claim 2 wherein said pneumatic cylinder (34) has a first carriage (29) connected thereto which includes a spring (38) having a tooth (39) disposed in operative association with said guide bar (14) for effecting movement of the latter to its inactive position by said cylinder.

4. The device according to claim 3 wherein said engaging and advancing means includes a plate (25) pivotably mounted on said first carriage (29) and movable with the latter in one direction to engage and advance the strip material on said guide bar (14) and in the opposite direction to pivot it from advancing engagement with the strip material.

5. The device according to claim 1 wherein said cutting means includes cutting blades (48) and a pneumatic cylinder (47) for supporting, actuating and moving said blades to that position to effect cutting of the strip material.

* * * * *